US005296660A

United States Patent [19]

Morel et al.

[11] Patent Number: 5,296,660

[45] Date of Patent: Mar. 22, 1994

[54] AUXILIARY SHUNT MULTIPLE CONTACT BREAKING DEVICE

[75] Inventors: Robert Morel, Eybens; Marc Serpinet, Jarrie; Xavier Thomassin, Meylan, all of France

[73] Assignee: Merlin Gerin, France

[21] Appl. No.: 8,314

[22] Filed: Jan. 25, 1993

[30] Foreign Application Priority Data

Feb. 7, 1992 [FR] France ..... 92 01487

[51] Int. Cl.[5] ..... H01H 9/38; H01H 33/12

[52] U.S. Cl. ..... 200/146 R

[58] Field of Search ..... 200/146 R, 144 R, 147 R, 200/278

[56] References Cited

U.S. PATENT DOCUMENTS

| | | | |
|---|---|---|---|
| 3,154,662 | 10/1964 | Heupel et al. | 200/243 |
| 3,365,561 | 1/1968 | Jencks et al. | 200/278 X |
| 3,735,075 | 5/1973 | Kidd | 200/146 R |
| 3,749,867 | 7/1973 | Rexroad | 200/146 R |
| 3,770,922 | 11/1973 | Gryctko | 200/146 R |
| 5,210,385 | 5/1993 | Morel et al. | 200/146 R |

FOREIGN PATENT DOCUMENTS

| | | |
|---|---|---|
| 0410902 | 1/1991 | European Pat. Off. . |
| 1107330 | 5/1961 | Fed. Rep. of Germany . |
| 1176239 | 8/1964 | Fed. Rep. of Germany . |
| 1305080 | 8/1962 | France . |

*Primary Examiner*—J. R. Scott

*Attorney, Agent, or Firm*—Parkhurst, Wendel & Rossi

[57] ABSTRACT

An electrical breaking device including a movable contact assembly. The movable contact assembly includes a support cage and upper and lower contact fingers pivotally mounted thereto on respective upper and lower transverse spindles. The upper and lower contact fingers are parallel to each other and each include a head having a movable contact at a first end thereof, and a second end opposite the first end which is connected to a flexible conductor. The lower and upper contact fingers are cooperable with a stationary contact assembly. The lower transverse spindle is positioned to be closer to the first end of the lower contact finger than to its second end. In contrast, the upper transverse spindle is positioned to be closer to the second end of the upper contact finger than to its first end. The longitudinal spacing between the upper end contact spindles yield an attraction force which counter-balances repulsion forces acting on the movable contacts through which a current flows.

10 Claims, 3 Drawing Sheets

AUXILIARY SHUNT MULTIPLE CONTACT BREAKING DEVICE

BACKGROUND OF THE INVENTION

The invention relates to an electrical breaking device with multiple contacts, particularly suitable for a low voltage multipole circuit breaker at high currents.

Traditionally, a breaking device comprises a movable contact assembly and a stationary contact assembly. With the aim of reducing the contact resistance and improving the electrodynamic withstand at the level of the contact parts, it is state-of-the-art to use a breaking device with multiple contacts. U.S. Pat. No. 5,210,385 describes a multipole circuit breaker in which the movable contact assembly of a pole is provided with a plurality of contact fingers which extend parallel in a longitudinal direction and which are pivotally mounted around a transverse direction. One of the ends of each finger, the head, is provided with a movable contact part, whereas the other end of each finger, the heel, is connected by a flexible conductor to a common stationary contact pad. The stationary contact assembly of each pole is provided with stationary contact parts, designed to cooperate, in the closed position, with the movable contact parts.

It is also state-of-the-art, for example according to U.S. Pat. No. 3,154,662 and German Patent Application No. 1,107,330, to make use of the electrodynamic forces developed at the level of the movable parts of a breaking device.

The object of the invention is to improve the electrodynamic withstand at the level of the contact parts, without however increasing the number of contact fingers. To this end, it makes use of the electrodynamic forces developed at the level of the contact fingers.

SUMMARY OF THE INVENTION

According to the invention, the movable contact assembly comprises at least one pair of contact fingers superposed in a plane perpendicular to the transverse direction, an upper finger pivotally mounted on a first transverse spindle closer to its heel than to its head, and a lower finger pivotally mounted on a second transverse spindle closer to its head than to its heel.

Due to the longitudinal offset of the two transverse pivoting spindles, the electrodynamic attraction forces developed at the level of the contact fingers tend to force the movable contact parts onto the stationary contact parts, i.e. to oppose the repulsion forces at the level of the contact parts.

Preferably, the heels of the upper and lower fingers terminate appreciably in the same transverse plane, and the first transverse spindle associated with the upper finger is located in the vicinity of its heel.

According to a particular embodiment, the longitudinal distance between the two transverse spindles is appreciably equal to twice the longitudinal distance separating the second spindle from the head of the lower finger; and the distance between the respective longitudinal cores of the two fingers is smaller than or equal to one third of the length of the lower finger.

BRIEF DESCRIPTION OF THE DRAWINGS

Other advantages and features will become more clearly apparent from the following description of an illustrative embodiment of the invention, given as a non-restrictive example only and represented in the accompanying drawings in which.

DESCRIPTION OF THE PREFERRED EMBODIMENT

Figure 1:
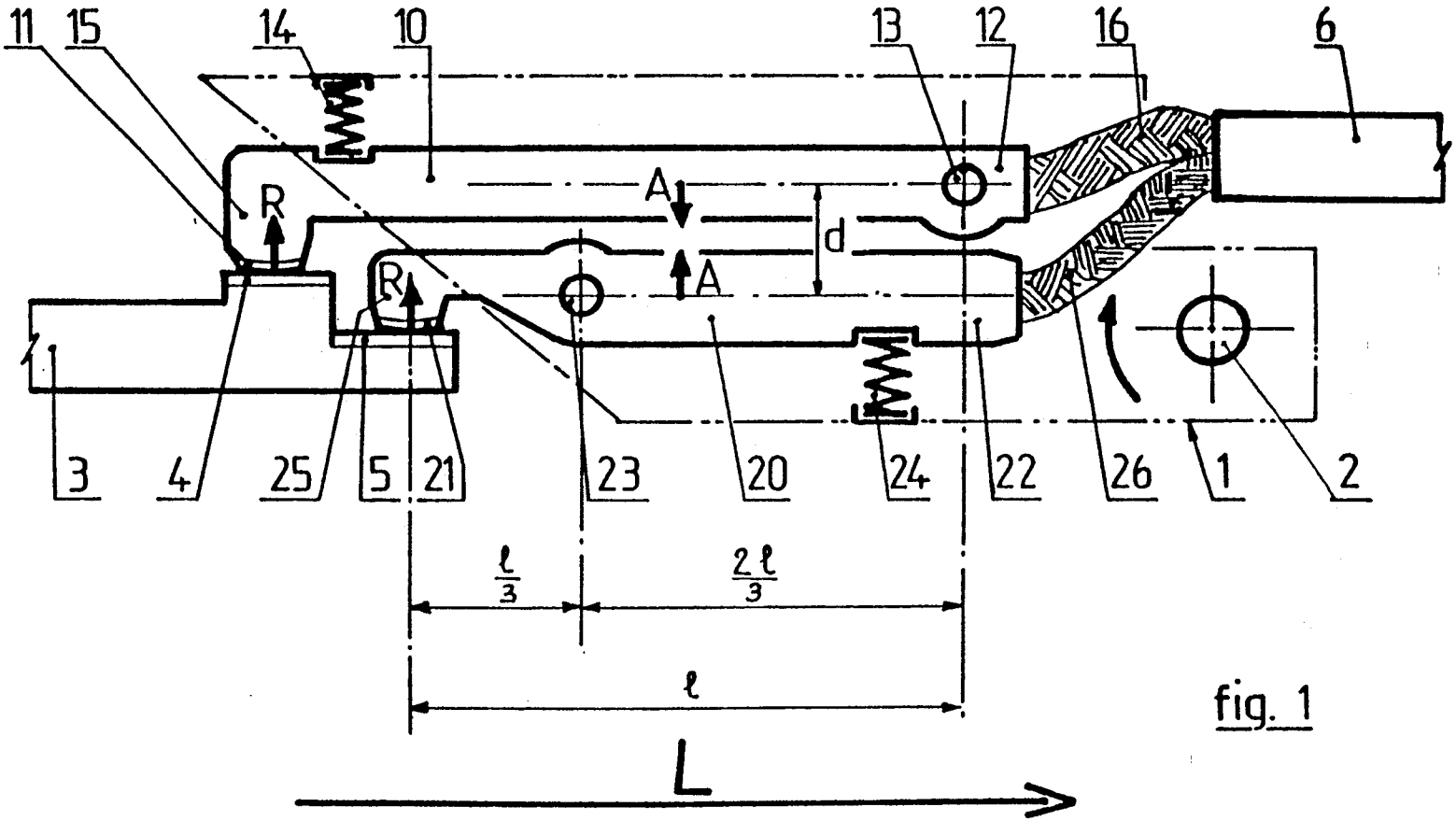
FIG. 1 is a schematic representation of the breaking device in the closed position.
Figure 2:
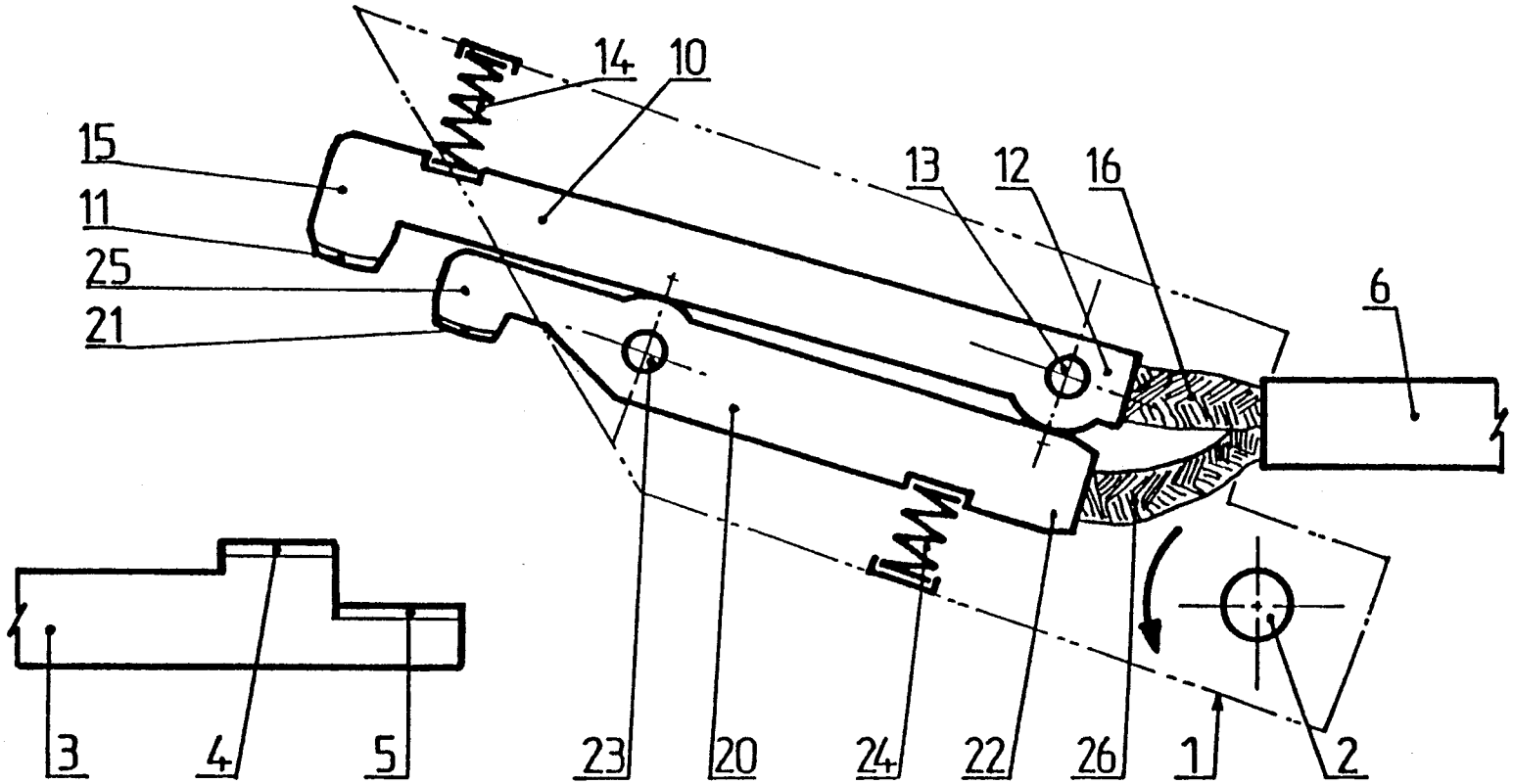
FIG. 2 is a schematic representation of the breaking device in the open position.

Referring to FIGS. 1 and 2, a movable contact assembly of the breaking device for a pole is schematically represented, including a support cage 1 pivotally mounted on a transverse spindle 2. The cage 1 which is preferably made from insulating material, and pivots around the spindle 2 between a closed position (FIG. 1) and an open position (FIG. 2).

The stationary contact assembly of the pole is schematically represented, as an example, by a stationary line-side pad 3, provided with two contact parts 4, 5.

Inside the cage 1, a pair of contact fingers 10, 20 extend parallel to the longitudinal direction L, superposed in the same longitudinal plane perpendicular to the transverse direction of the spindle 2.

The head 15 of the finger 10, designated as the upper finger 10 with respect to the stationary line-side pad 3, is provided with a movable contact part 11 designed to cooperate with the stationary contact part 4. The other end, of the finger 10, designated as the heel 12, is connected to a flexible conductor 16, for example a braided strip, which electrically connects the upper finger 10 to the load-side stationary contact pad 6.

Similarly, the contact finger 20, designated as the lower contact finger 20, is provided at its head 25 with a movable contact part 21 designed to cooperate with the stationary contact part 5. The other end of the lower finger 20, the heel 22, is connected by a braided strip 26 to the load-side stationary contact pad 6.

In the closed position, the two fingers 10, 20 therefore have electrical currents respectively parallel to one another and of the same direction flowing through them. Preferably, the two fingers 10, 20 have appreciably identical cross-sections, so as to have appreciably equal currents flowing through them.

According to the invention, the upper finger 10 is pivotally mounted on a transverse spindle 13 closer to its heel 12 than to its head 15, whereas the lower finger 20 is pivotally mounted on another transverse spindle 23 closer to its head 25 than to its heel 22.

The resulting longitudinal offset between the two transverse spindles 13, 23 has the effect of making the resultants A of the electrodynamic attraction forces exerted on the fingers 10, 20 between the two spindles 13, 23 act as levering forces which tend to rock the fingers 10, 20 to a closed position, and therefore to oppose the repulsion forces R at the level of the movable contact parts 11, 21.

Given that the electrodynamic attraction forces A and repulsion forces R follow appreciably identical laws according to the intensity of the electrical current flowing in the device, it is possible to obtain a good compensation of all the electrodynamic forces present.

In other words, the device is particularly suitable for a low voltage circuit breaker at high currents, as the repulsion forces R can be perfectly compensated by the attraction forces A, whatever the current intensity.

According to a preferred embodiment, the heels 12, 22 are located in the same transverse plane, the upper finger 10 being slightly longer than the lower finger 20, so that the head 15 slightly extends beyond the head 25, thus enabling the movable contact parts 11, 21 to come into contact with the stationary contact parts 4, 5.

Advantageously, the transverse spindle 13 is located near the heel 12. To obtain a good compensation of the repulsion forces R by the attraction forces A, the transverse spindle 23 will then be located at a longitudinal distance (21/3) from the spindle 13 which is appreciably twice the longitudinal distance ($\frac{l}{3}$) separating the spindle 23 from the head 25. A distance d will be chosen between the respective cores of the upper finger 10 and lower finger 20 to be smaller than or equal to one third of the length 1 separating the transverse spindle 13 from the contact point between the stationary contact part 5 and movable contact part 21. The length 1 therefore is appreciably equal to the length of the lower finger 20.

The upper finger 10 and lower finger 20 can moreover be equipped with contact pressure springs. According to the embodiment illustrated by FIGS. 1 and 2, the upper finger 10 is subjected to a contact pressure spring 14 placed between the cage 1 and finger 10, and acting on the latter in the vicinity of the head 15. The lower finger 20 is subjected to a contact pressure spring 24 placed between the cage 1 and finger 20, and acting in the vicinity of the heel 22.

Figure 3:
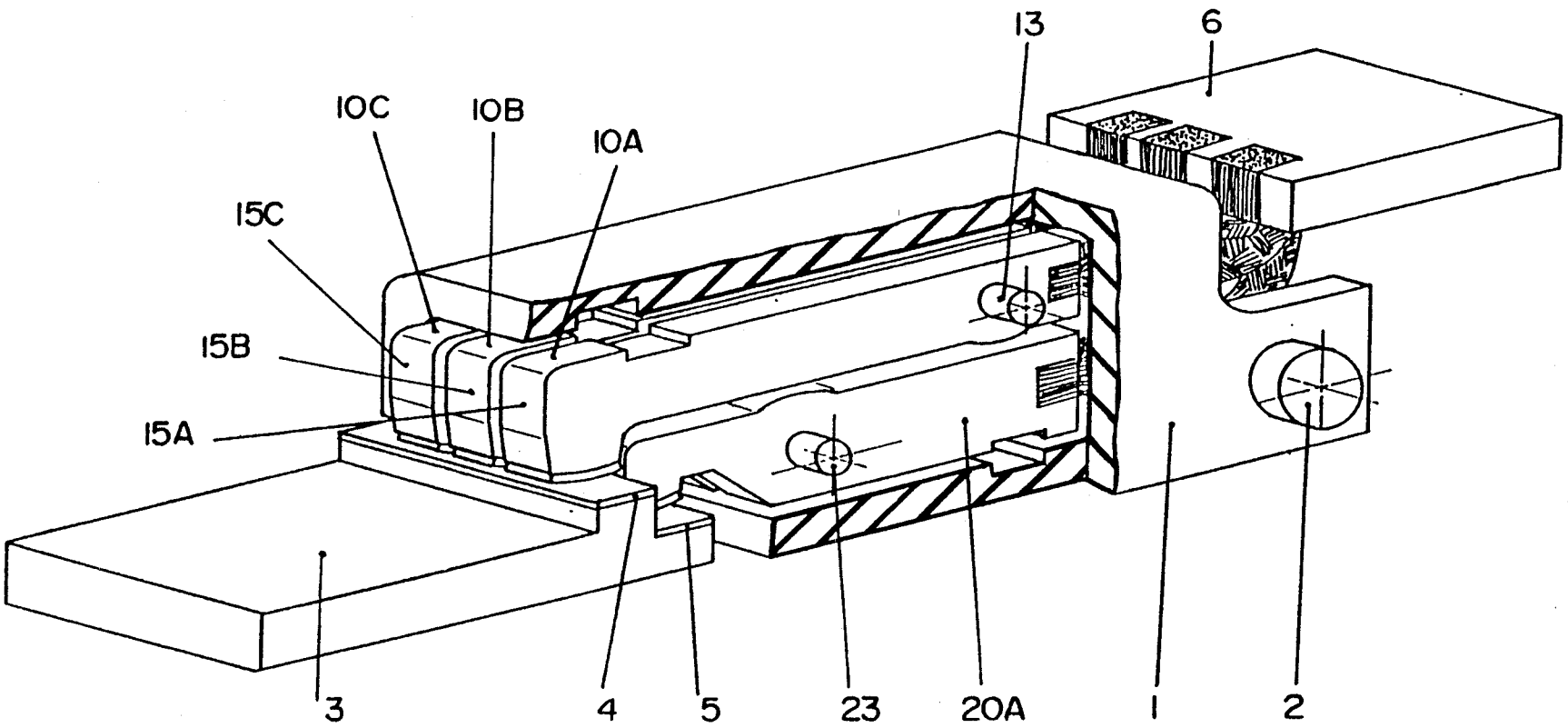
FIG. 3 is an exploded perspective view of a breaking device comprising three pairs of fingers, arranged in parallel side by side in the transverse direction.

As illustrated by FIG. 3, whose references correspond to those of FIGS. 1 and 2, each pole of the breaking device described above can comprise two or more pairs of upper fingers 10A, 10B, 10C, and lower fingers 20A, 20B, 20C, arranged in parallel side by side in the transverse direction, the set of upper fingers 10A, 10B, 10C then being pivotally mounted on the same transverse spindle 13, and the set of lower fingers 20A, 20B, 20C being pivotally mounted on the same transverse spindle 23. The common line-side contact pad 3 is provided with two stationary contact parts 4 and 5 common to all the pairs of fingers. Similarly, the load-side contact pad 6 is also common to all the pairs of fingers.

We claim:

1. An electrical breaking device, comprising:

a movable contact assembly comprising a support cage, a lower contact finger and an upper contact finger, said lower and upper contact fingers being pivotally connected to said support cage via respective lower and upper transverse spindles which extend along a transverse direction, said upper contact finger being superposed on said lower contact finger in a plane perpendicular to the transverse direction, said lower and upper contact fingers being parallel to each other and extending along a longitudinal direction, each of said lower and upper contact fingers having a first end defined by a head having a movable contact and a second end opposite said first end, the second end of each contact finger being connected to a stationary contact pad via a flexible conductor; and a stationary contact assembly comprising first and second contact parts for electrical connection with respective movable contacts of the lower and upper contact fingers, wherein said lower transverse spindle is positioned to be closer to said first end than to said second end of said lower contact finger, and said upper transverse spindle is positioned to be closer to the second end than the first end of the upper contact finger such that said lower and upper transverse spindles are spaced apart from each other a distance along said longitudinal direction.

2. The device of claim 1, wherein said second ends o the lower and upper fingers terminate in substantially the same transverse plane which is perpendicular to said longitudinal direction, and wherein the upper contact finger is longer than said lower contact finger such that the head of the upper contact finger extends beyond the head of the lower contact finger.

3. The device of claim 1, wherein the upper transverse spindle is positioned at the second end of the upper contact finger.

4. The device of claim 1, wherein said distance between the lower and upper spindles is approximately twice the distance between the first end of the lower contact finger and the lower transverse spindle.

5. The device of claim 1, wherein a distance between central longitudinal axes of the upper and lower contact fingers is not greater than one-third the length of the lower contact finger.

6. The device of claim 1, wherein said first and second contact parts are located in two different planes which are parallel to said longitudinal direction.

7. The device of claim 1, wherein said cage comprises an insulating material.

8. The device of claim 1, wherein said movable contact assembly further comprises an upper spring connected between the upper contact finger and said support cage, and a lower spring connected between said lower contact finger and said support cage.

9. The device of claim 1, further comprising a plurality of lower contact fingers and a plurality of upper contact fingers.

10. The device of claim 1, wherein said cage is pivotally connected to a frame via a cage transverse spindle.

* * * * *